US007128096B2

(12) United States Patent
Debaes et al.

(10) Patent No.: US 7,128,096 B2
(45) Date of Patent: Oct. 31, 2006

(54) DEVICE FOR CUTTING DISCARDED PILE LOOP WEFT YARNS IN A FABRIC AND WEAVING MACHINE PROVIDED WITH SUCH DEVICE

(75) Inventors: Johny Debaes, Moorslede (BE); Bart Deneir, Lauwe (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 87 days.

(21) Appl. No.: 11/045,479

(22) Filed: Jan. 31, 2005

(65) Prior Publication Data

US 2005/0166989 A1 Aug. 4, 2005

(30) Foreign Application Priority Data

Jan. 30, 2004 (BE) ..... 2004/0049

(51) Int. Cl.
*D03D 39/20* (2006.01)
*D03D 39/24* (2006.01)
*D03D 39/22* (2006.01)

(52) U.S. Cl. ..... 139/46; 139/116.1; 139/116.5; 139/39; 139/43; 139/44

(58) Field of Classification Search ..... 139/116.1, 139/116.5, 39, 43, 44, 46
See application file for complete search history.

(56) References Cited

U.S. PATENT DOCUMENTS 1,970,443 A * 8/1934 Cooper et al. ..... 139/21
2,759,495 A * 8/1956 Masland ..... 139/39
2,936,004 A * 5/1960 Janney ..... 139/404
2,981,292 A * 4/1961 Hoeselbarth ..... 139/39
3,060,974 A * 10/1962 Hoffman ..... 139/43
3,140,592 A * 7/1964 Clark ..... 66/85 R
3,308,855 A * 3/1967 Power et al. ..... 139/116.1
3,636,988 A * 1/1972 Troy et al. ..... 139/46
6,817,383 B1 * 11/2004 Debaes et al. ..... 139/21
6,837,274 B1 * 1/2005 Debaes et al. ..... 139/21

FOREIGN PATENT DOCUMENTS

BE 1014269 7/2003
EP 1347087 9/2003

* cited by examiner

*Primary Examiner*—John J. Calvert
*Assistant Examiner*—Robert H Muromoto, Jr.
(74) *Attorney, Agent, or Firm*—James Creighton Wray

(57) ABSTRACT

A device and weaving machine using the device for cutting discarded pile loop weft yarns in a fabric that is composed of a backing fabric consisting of weft yarns and warp yarns and that contains pile warp yarns by which, in one or several zones, pile loops are formed over discarded pile loop weft yarns, device being provided with a cutting blade to cut the discarded pile loop weft yarns, the device comprising a guiding needle that extends between two rows of pile positioned side by side in the direction of the warp, and the device being provided with two or several guiding yarns in the direction of the warp that push this side by side positioned pile away from the guiding needle and the cutting blade in the direction of the weft and that, at the same time, pull the discarded pile loop weft yarns away from the backing fabric in order to present them over the guiding needle to the cutting blade so that they can be severed.

27 Claims, 7 Drawing Sheets

DEVICE FOR CUTTING DISCARDED PILE LOOP WEFT YARNS IN A FABRIC AND WEAVING MACHINE PROVIDED WITH SUCH DEVICE

This application claims the benefit of Belgian Application No. 2004/0049 filed Jan. 30, 2004.

Belgian Application No. 2004/0049 filed Jan. 30, 2004 is hereby incorporated by reference in its entirety.

BACKGROUND OF THE INVENTION

On the one hand, the invention relates to device for cutting discarded pile loop weft yarns in a fabric that is composed of a backing fabric consisting of weft yarns and warp yarns, and that comprises pile warp yarns by which, in one or several zones, pile loops over discarded pile loop weft yarns are formed, whereas the device is provided with a cutting blade to cut the discarded pile loop weft yarns.

On the other hand, the invention relates to a weaving machine that is provided with such device. The device according to the invention can be either a single-piece weaving machine or a face-to-face weaving machine.

To weave pile loops in fabrics, two procedures are commonly used:

In one method, the pile loops are shaped by introducing weaving rods in the direction of the weft, over which the loop pile is laid. Then, after one or several beats of the reed, the weaving rod is pulled out of the fabric and the pile forms a loop.

In the other method, lancets are installed in the direction of the warp that serve as spacers to carry a discarded weft yarn that is introduced as a pile loop weft yarn, over which the loop pile is laid. After the thus shaped part of the fabric has left the top of the lancet, the discarded pile loop is removed from the fabric and the pile forms a loop.

In the second procedure, removal of the discarded pile loop weft yarn can be performed in several ways, for instance by inserting a weft yarn made of yarn material that can be washed out of the fabric by a washing process. More commonly, the discarded pile loop weft yarn is removed from the fabric by pulling the discarded pile loop weft yarn out of the fabric. In such process, we pull for instance at the selve edge in which the discarded pile loop weft yarn is attached, or we use extra gripping devices to pull the discarded pile loop weft yarn out of the formed fabric, as is for instance described in BE 1 014 269. When this procedure is applied to larger weaving widths (more than 2 m), it is also a common practice to cut the discarded pile loop weft yarn in the middle of the fabric, and the thus created two parts of the discarded pile loop weft yarn are pulled out from both sides of the weaving machine. In the figures of BE 1 014 269, a knife is positioned in the centre at the fabric side and facing the lancets, in order to cut the discarded pile loop weft yarns in their middle. However, the text of BE 1 014 269 does neither specify how this is accomplished, nor how the device is built. As can be deducted from the first figure, this happens shortly after the fabric edge has been formed and beyond the point where the fabric leaves the lancets.

EP 1 347 087 describes a procedure and device for weaving fabrics with pile loops in face-to-face mode, in which the discarded pile loop weft yarn is severed by a cutting blade that is incorporated in one of the lancets in the centre of the weaving width. Such cutting lancet is present both in the row of the upper spacers and in the row of the lower spacers.

This procedure has a significant number of drawbacks.

The cutting of the discarded pile loop weft yarn takes place between the upper fabric and the lower fabric, completely out of the weaver's sight.

Replacing the cutting blade in the lancet is rather complicated because the entire lancet must be dismounted and reinstalled for this, which could lead to possible damage of the surrounding warp yarns.

In addition, it is difficult to observe and difficult to detect if cutting of the discarded pile loop weft yarn has failed for one or the other reason.

When the weaver is working with his hands in the vicinity of the top of the cutting lancets, which he only can see with great difficulty, he runs the risk of injuring himself on the cutting blades.

In addition, it often occurs that the cutting lancet provided for cutting of the discarded pile loop weft yarn for the upper fabric, which, most of the times, is located in a different reed dent than the one provided for cutting of the loop weft in the bottom fabric, cuts both the discarded pile loop weft yarn for the top fabric and the discarded pile loop weft yarn for the bottom fabric. In this case, when the discarded pile loop weft yarn is pulled out from both sides, a small piece of the discarded pile loop weft yarn remains behind in the middle of the fabric, which either can come loose at a later moment or create an uneven effect in the fabric, or both.

SUMMARY OF THE INVENTION

On the one hand, the purpose of the invention is to provide device that does not present any of the above-mentioned drawbacks. On the other hand, the purpose of the invention is to provide a weaving machine that is equipped with such device so that the above-mentioned drawbacks do not occur.

On the one hand, the purpose of the invention is reached by providing device for cutting discarded pile loop weft yarns in a fabric that is composed of a backing fabric consisting of weft yarns and warp yarns and that contains pile warp yarns by which, in one or several zones, pile loops are formed over discarded pile loop weft yarns, said device being provided with a cutting blade to cut the discarded pile loop weft yarns, in which said device comprises a guiding needle that extends between two rows of pile positioned side by side in the direction of the warp, and said device being provided with two or several guiding yarns in the direction of the warp that push this side by side positioned pile away from the guiding needle and the cutting blade in the direction of the weft and that, at the same time, pull the discarded pile loop weft yarns away from the backing fabric in order to present them over the guiding needle to the cutting blade so that they can be severed.

By pile are understood pile loops and pile burls, as well as any other elements of the fabric pattern that can be obtained by means of pile warp yarns.

In this way, the guiding yarns create a space to guide the discarded pile loop weft yarns over the top of the guiding needle where they are presented to the cutting blade and at the same time to prevent the nearby pile burls and pile loops from being damaged by the cutting blade.

In a preferred embodiment of device according to the invention, the guiding needle is provided with a first guiding eye through which the guiding yarns are threaded.

In this embodiment, the guiding yarns preferably cross in relation to the guiding needle when they extend through the first guiding eye of the guiding needle.

In an advantageous embodiment of device according to the invention, the device is provided with a holder plate that, in the direction of the warp, is provided at both sides of the cutting blade with second guiding eyes, guiding sleeves or guiding tubes that guide the guiding yarns.

In a preferred device according to the invention, the device is provided with a floating part to which the guiding needle and the cutting blade are attached.

The provision of the floating part has the advantage that, when, during its movement towards the cloth winding roller or the cloth lay down unit, the fabric makes a small sideways movement in the direction of the weft and, consequently, the warp yarns do not remain continuously in their position in the direction of the weft, the guiding needle and the cutting blade nonetheless continue on the right path between the side by side rows of pile.

In a specific preferred embodiment of device according to the invention, the floating part consists of a rod device, i.e. two sideways rods, an upper and a lower rod in the shape of a parallelogram, in which, upon rotation of the sideways rods, the lower rod performs a virtually horizontal movement.

In this, the upper rod is the holder plate of the device self, a component of this or an extra rod provided to the holder plate.

In another specific preferred embodiment of device according to the invention, the floating part is executed as a holder in which the cutting blade and the guiding needle are integrated and that, in relation to the holder plate, is provided in a floating and slideable way in the direction of the weft via a linear guide.

To detect any breakage of the guiding yarns, the device is preferably provided with a yarn breakage detection device.

It is advantageous to provide a yarn breakage detection device; this because of the importance of the guiding yarns for presenting the pile loop weft yarns properly to the cutting blade. In this manner, when breakage of one or several of the guiding yarns is detected, a signal is generated, whereupon, depending on the settings of machine control, it may for instance be decided to stop the machine in order to be able to repair the guiding thread.

In an advantageous embodiment of device according to the invention, the cutting blade or the cutting blade with the guiding needle is provided detachably in a blade holder.

The advantage of this is that the cutting blade or the cutting blade with the guiding needle can easily be removed from the blade holder for inspection or replacement.

In a preferred embodiment of device according to the invention, devices are provided on the blade holder for adjustment of the distance between the guiding needle/cutting blade and the backing fabric.

The device is preferably provided with a masking plate to mask the cutting blade.

By this, a weaver who rubs over the carpet cannot injure himself on the cutting blade.

On the other hand, the purpose of the invention is obtained by providing a weaving machine for weaving a fabric that is composed of a backing fabric consisting of weft yarns and warp yarns and that comprises pile warp yarns by which in one or several zones pile loops are formed over discarded pile loop weft yarns, said weaving machine being provided with a device as described above.

In an advantageous embodiment of device according to the invention, the guiding yarns are spread over two reed dents positioned side by side.

In this embodiment, more than one guiding thread can be provided per reed dent.

In this way, the pile rows that are positioned side by side are pushed away more forcefully and they are better protected against damage from the cutting blade. This also creates a larger space to present the pile loop weft yarn to the cutting blade.

In a preferred weaving machine according to the invention, the device is attached to the frame of the weaving machine by means of said holder plate.

On the one hand, in such machine, the holder plate can be attached slideably to the frame of the weaving machine in the direction of the weft and away from and towards the fabric.

On the other hand, the holder plate can be executed as a first part and a second part, in which the first part is attached slideably in relation to the frame of the weaving machine in order to determine the position in the direction away from and towards of the fabric, and the second part is positioned slideably in relation to the first part in order to determine the position in the direction of the weft.

In a first embodiment of a weaving machine according to the invention, the guiding yarns consist of fixed cords that are attached at one of their ends to the frame of the weaving machine.

In a second embodiment of a weaving machine according to the invention, the guiding yarns are warp yarns running with the fabric that extend into the shedding zone of the weaving machine through the eyes of heddles.

In this embodiment, the heddles can be suspended in a fixed weaving frame or to the frame of the weaving machine, or they can be controlled by hooks of a jacquard machine.

In an advantageous embodiment of a weaving machine according to the invention, in relation to the weaving direction, the device is positioned in the weaving machine just before the zone in which the discarded pile loop weft yarns at both sides are pulled out of the fabric.

If this is not done, the discarded pile loop weft yarns are present in the fabric without control and especially the trimmings of the severed discarded pile loop weft yarns can move and entangle in an uncontrolled manner in the middle position. By fitting the device in the weaving machine at that location, the discarded pile loop weft yarns remain tensioned for a longer period and they are quickly pulled out after cutting.

The weaving machine is preferably provided with a guiding part by which, at the location of the cutting blade and the guiding needle, the fabric is supported at its backside.

The advantage of this is that any possible swinging of the woven fabric during its movement in the direction of the warp is cancelled out and consequently that it does not disturb the cutting process.

In a specific embodiment of a weaving machine according to the invention, the weaving machine is a face-to-face weaving machine.

In the face-to-face weaving machine, the device is preferably positioned in the zone where the upper and lower fabrics are separate from each other.

In this way, the weaver has a good view of the cutting of the discarded pile loop weft yarns.

When the guiding yarns are fixed cords, these fixed cords are attached by one of their ends to the frame of the face-to-face weaving machine, and by their other end to the cutting device of the face-to-face weaving machine, which is provided for separation of the upper and lower fabric.

When the face-to-face weaving machine comprises three grippers to insert the weft yarn, i.e. an upper, middle and lower gripper, whereby the warp yarns that run with the fabric are, for the upper fabric, continuously positioned between the weft brought in by the upper gripper and the weft brought in by the middle gripper, and for the lower fabric, are continuously positioned between the weft brought in by the lower gripper and the weft brought in by the middle gripper.

This invention will now be explained further by means of the hereafter following detailed description of a preferred device and a weaving machine provided with such device according to the invention. The sole purpose of this description is to give an example in order to illustrate the invention and indicate further advantages and details of said invention. Consequently, this description cannot be interpreted in any way as a limitation of the field of applicability of the invention or of the claimed patent rights.

In this detailed description, reference is made by means of numbers to the enclosed drawings, in which:

DETAILED DESCRIPTION OF THE PREFERRED EMBODIMENTS

Figure 1:
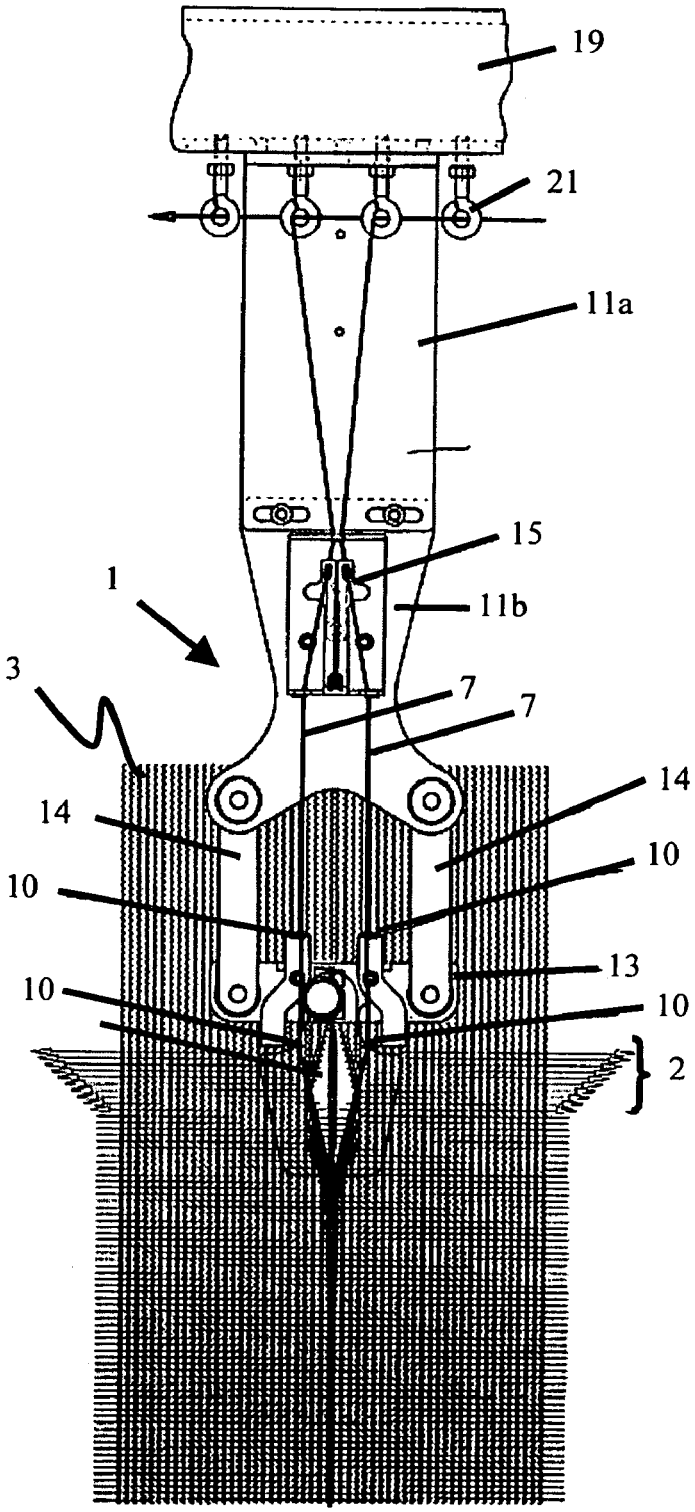
FIG. 1 presents a front view of the device according to the invention in its position with regard to the fabric and with its connection to the frame of the weaving machine.
Figure 2:
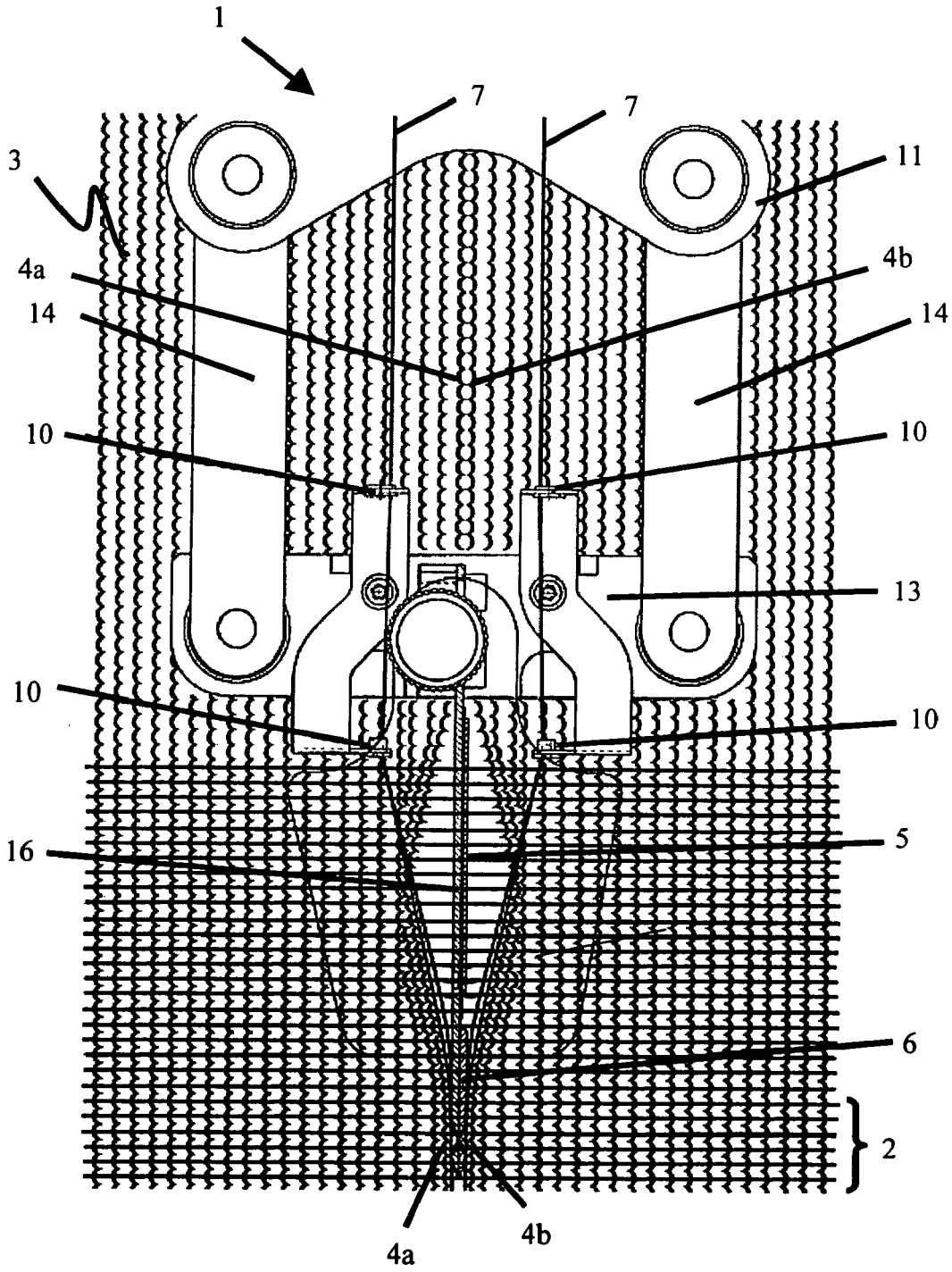
FIG. 2 presents a front view of the floating part of the device in its position with regard to the fabric.
Figure 7:
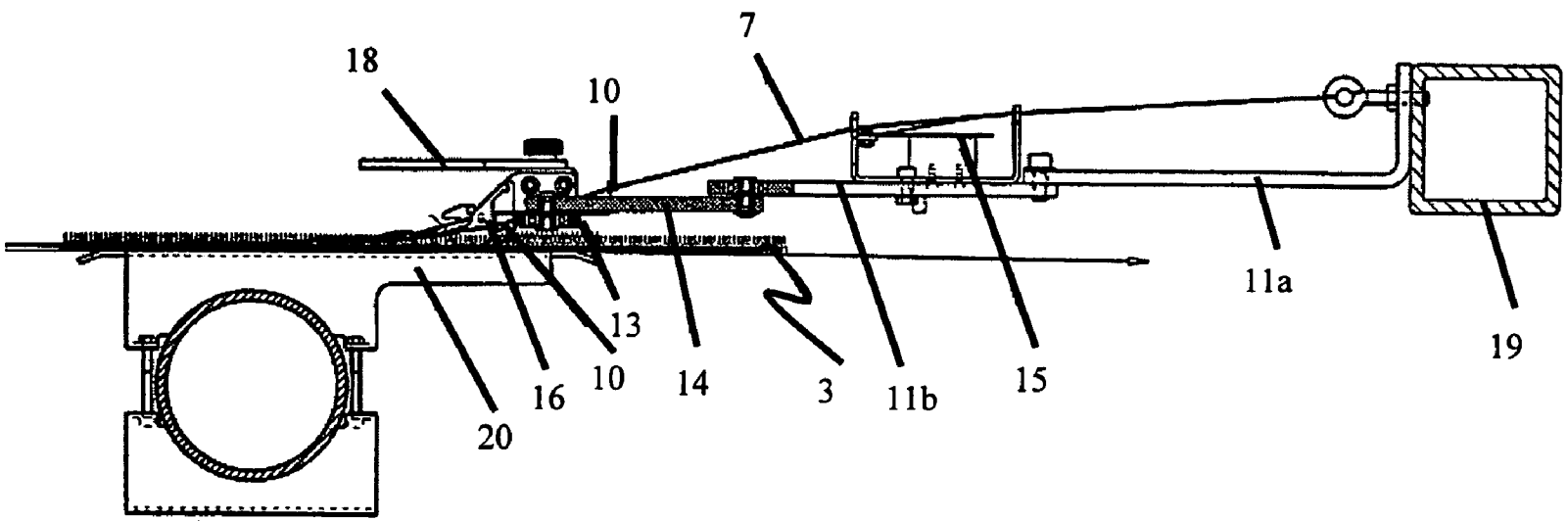
FIG. 7 presents a side view of the device in its position with regard to the fabric and with its connection to the frame of the weaving machine.

The device (1) according to the invention is provided for cutting discarded pile loop weft yarns (2) in a fabric (3), as is presented in FIGS. 1, 2 and 7. In this, the fabric (3) is composed of a backing fabric (100) (see FIG. 3) consisting of weft yarns and warp yarns, and it comprises pile warp yarns by which pile loops (4) over discarded pile loop weft yarns are formed in one or several zones. The device (1) is provided with a cutting blade (5) to cut the discarded pile loop weft yarns (2). In addition, the device (1) comprises a guiding needle (6) that extends between two rows of pile (4*a*, 4*b*) positioned side by side in the direction of the warp. By pile are understood pile loops and pile burls, as well as any other elements that are part of the fabric pattern and that can be obtained by means of pile warp yarns. In addition, the device (1) is provided with two or more guiding yarns (7) in the direction of the warp, that push these side by side positioned pile rows away from the guiding needle (6) and the cutting blade (5) in the direction of the weft, and that at the same time pull the discarded pile loop weft yarns (2) away from the backing fabric in order to present them over the guiding needle (6) to the cutting blade (5) so that they can be cut. At least two of such guiding yarns (7) are needed per fabric. To keep the pile away from the cutting blade (5), it is essential that, during threading of the warp yarns through the reed, no pile warp yarns are positioned in the direction of the weft between the guiding yarns (8) for a fabric (3), this to prevent that at the position of the guiding needle (6) pile would be present in the finished fabric (3) between the guiding yarns (8) in the direction of the weft. Therefore, the guiding yarns (8) extend between two rows of pile positioned side by side (4*a*, 4*b*).

Preferably, the guiding needle (6) is provided at the top with a first guiding eye (8) through which the guiding yarns (7) are threaded. In relation to the guiding needle (6), the guiding yarns (7) preferably cross when they extend through the first guiding eye (8) of the guiding needle (6). Both guiding yarns (7) are guided through second guiding eyes (10), guiding sleeves or guiding tubes. These second guiding eyes (10) are placed at both sides of the cutting blade (5).

Figure 4:
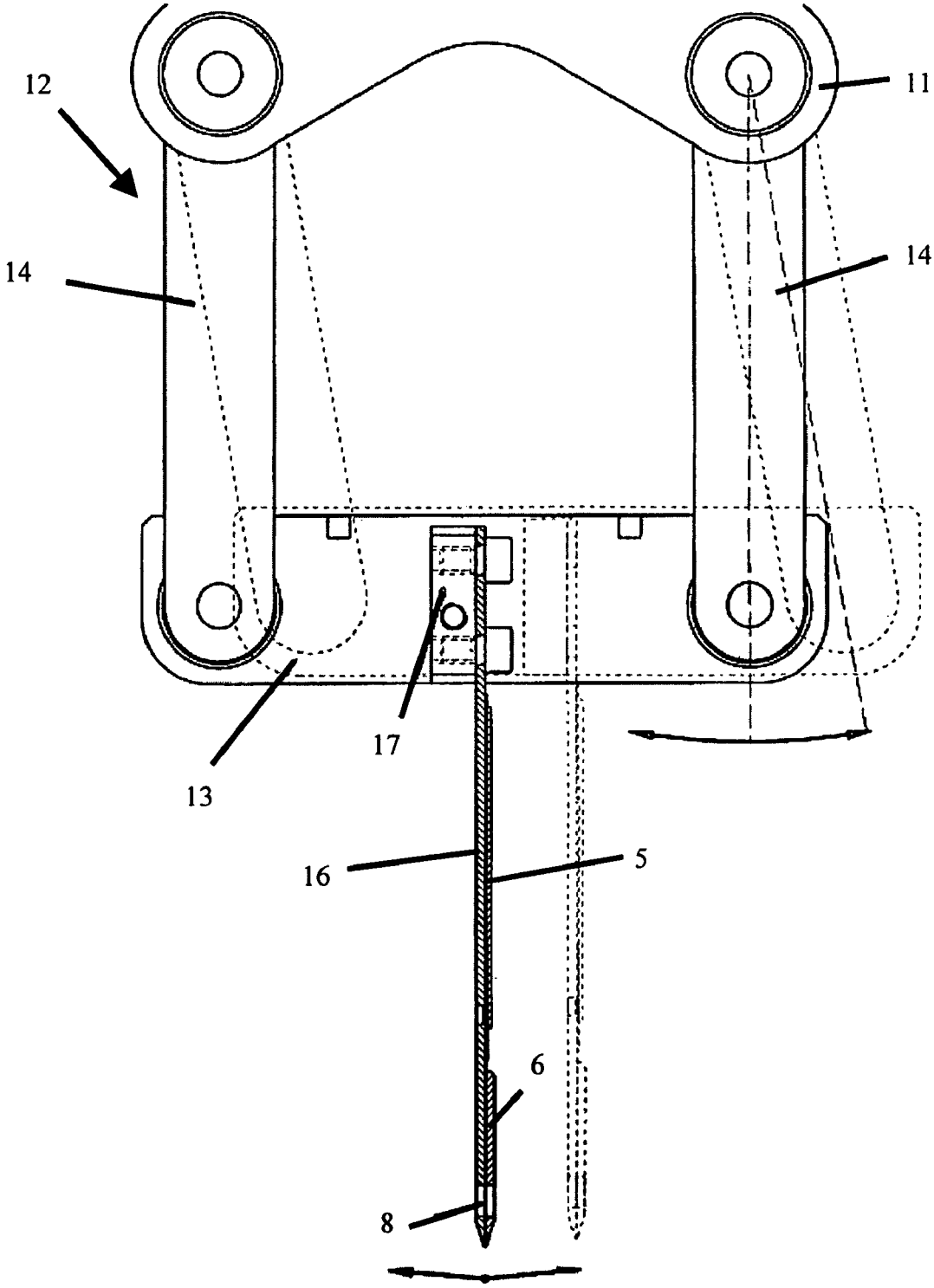
FIG. 4 presents a front view of the floating part of the device, independent from the fabric, with indication of the degree of freedom of movement of the floating part of the device.
Figure 5:
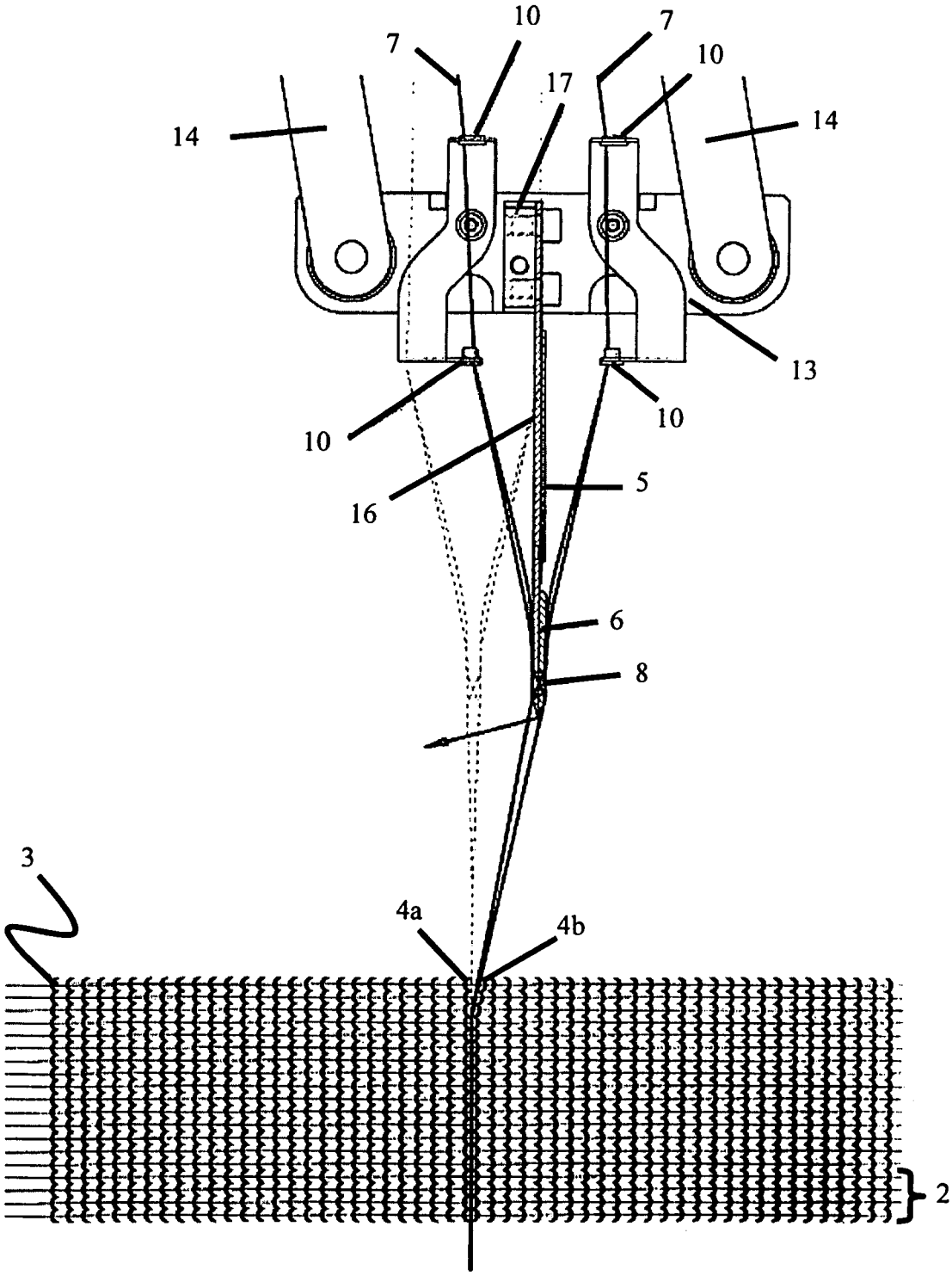
FIG. 5 presents a front view of the floating part of the device at the transit between two fabrics in the direction of the warp, i.e. the zone in which only backing fabric can be seen.

When the guiding needle (6) located between two rows of pile (4*a*, 4*b*), positioned side by side, is provided rigidly, it can damage said pile rows (4*a*, 4*b*). To prevent this, the device (1) is preferably provided with a floating part (12) as presented in FIGS. 4 and 5. In this way, the guiding needle (6) and the cutting blade (5) can follow their way between the rows of pile (4*a*, 4*b*) that are positioned side by side. This floating part (12) may be executed in different ways. The floating part (12) may consist of a rod device in the shape of a parallelogram, i.e. a lower rod (13), two sideways rods (14) and an upper rod that may be the holder plate (11) of the device self or a component of it or an extra rod provided on the holder plate (11) (not shown in the figure). The floating part (12) may also be executed as a holder for the cutting blade (5) with a guiding needle (6) that, in relation to the holder plate (11) of the device (1), can slide floatingly in the direction of the weft (linear guidance). When the guiding needle (6) arrives in a zone where no pile (4) is formed, for instance, in a zone between two carpets in a direction of the warp, where only backing fabric is formed as visible fabric, then the guiding needle (6) is no longer guided between two rows of pile (4*a*, 4*b*) positioned side by side. By providing the floating part (11) in combination with the guiding yarns (7), the guiding needle (6) moves again between the desired rows of pile (4*a*, 4*b*) that are positioned side by side when there is again pile (4) present in the fabric (3).

Because of the importance of the guiding yarns (7) in order to allow presenting the discarded pile loop weft yarns (2) properly to the cutting blade (5), it is advantageous to provide the device (1) with a warp yarn breakage detection device (15). This warp yarn breakage detection device (15) monitors the guiding yarns (7) so that in case of breakage of the guiding yarns (7) a signal is generated, whereby for instance, depending on the settings of the machine controls, the weaving machine is stopped in order to be able to repair the guiding yarns (7).

Figure 6A:
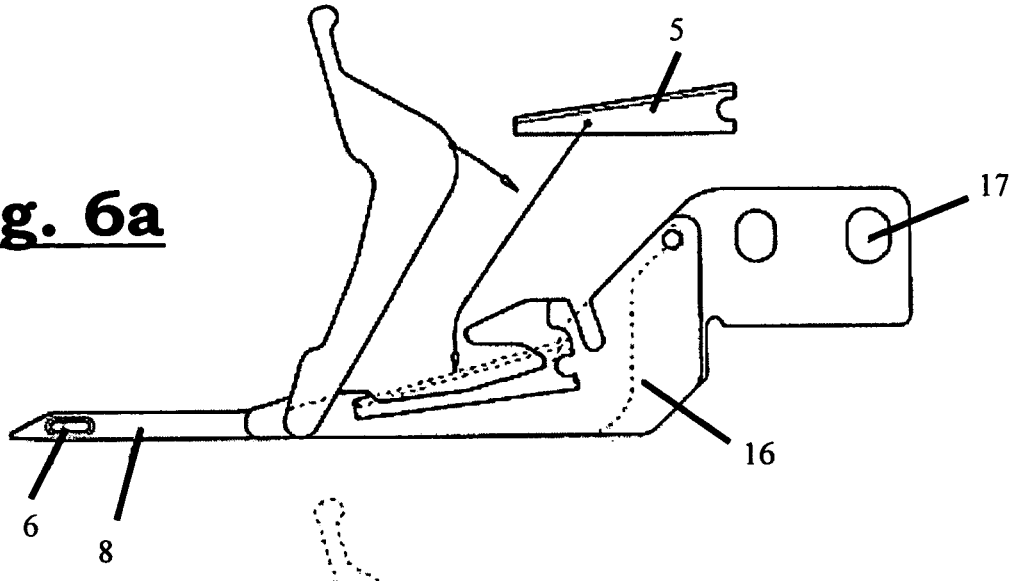
FIG. 6*a* presents a side view of the blade holder with the cutting blade taken out.
Figure 6B:
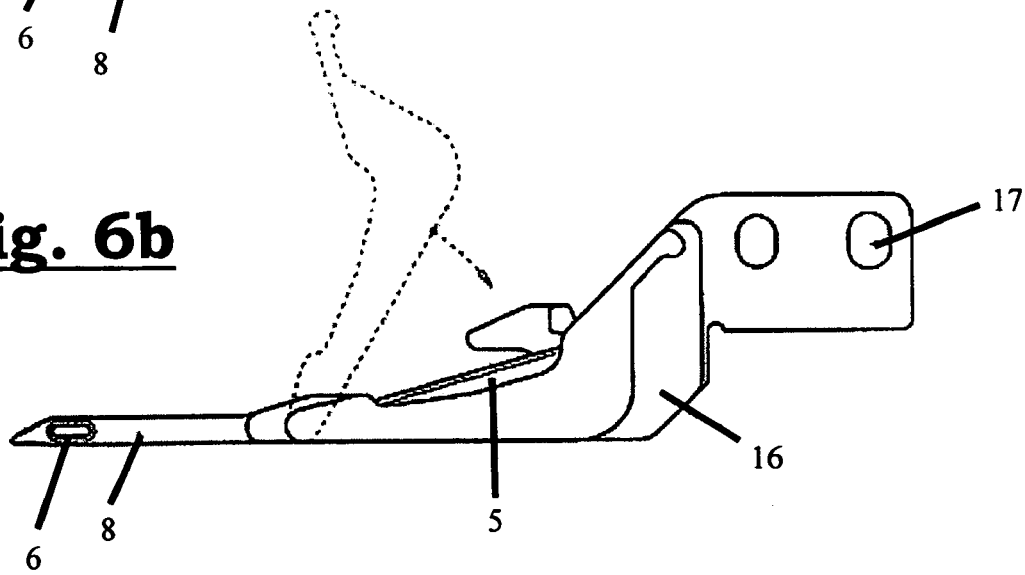
FIG. 6*b* presents a side view of the blade holder with the cutting blade inserted.

The device (1) is preferably made in a way that the cutting blade (5) or the cutting blade (5) with the guiding needle (6) is provided in a detachable manner in a blade holder (16), as presented in FIGS. 6*a* and 6*b*. In this way, the cutting blade (5) or the cutting blade (5) with the guiding needle (6) (not shown in the figure) can easily be taken out of the blade holder (16) for inspection or replacement. As further shown in FIG. 6, the device (1) can also be provided with devices for adjustment of the distance (17) between the guiding needle (6)/cutting blade (5) and the backing fabric (100).

Figure 3:
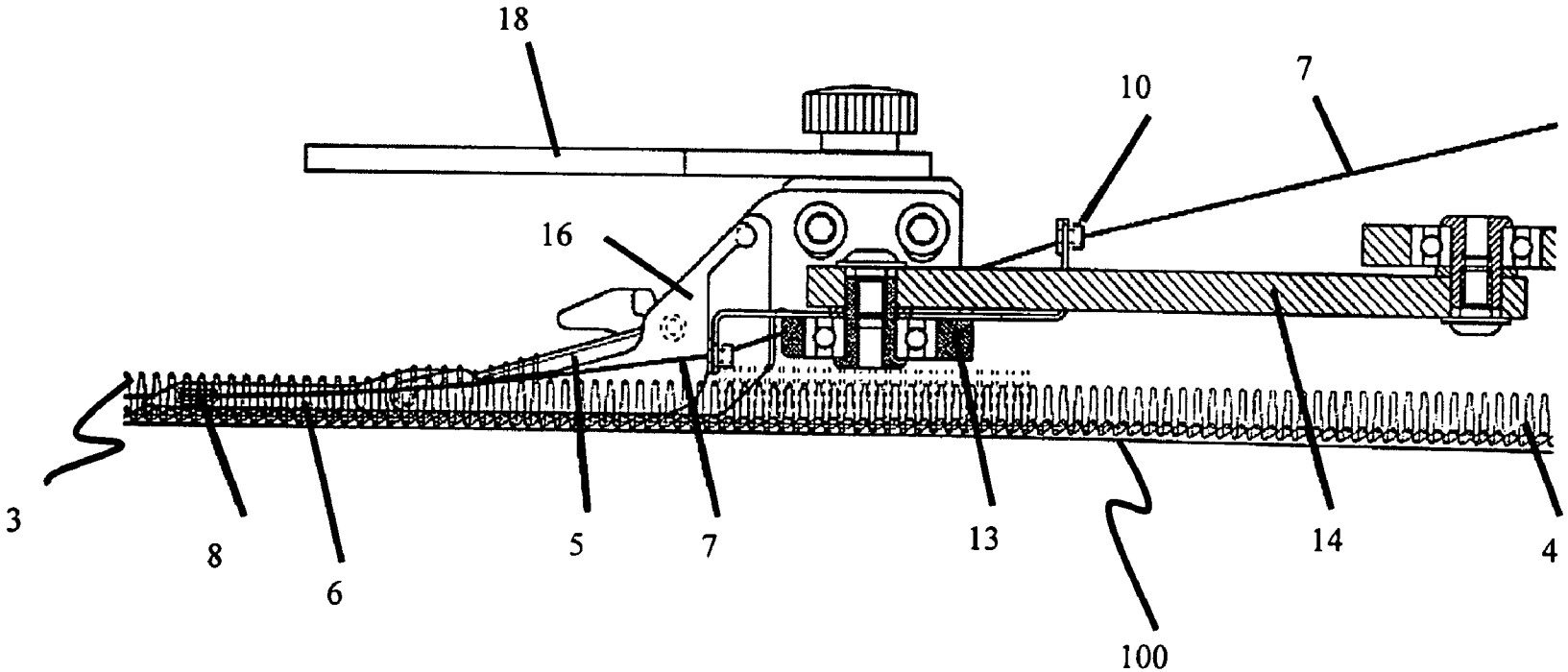
FIG. 3 presents a side view of the floating part of the device in its position with regard to the fabric.

In addition, the device (1) is provided with a masking plate (18) as shown in FIGS. 3 and 7 to mask the cutting blade (5). In this manner, the weaver cannot injure himself by the cutting blade (5), for instance, when he rubs over the fabric (3).

The device (1) according to the invention is attached to the weaving machine by means of the holder plate (11). This holder plate (11) is slideably attached to the frame of the weaving machine (19) in the direction of the weft and away from and towards the fabric (3). As presented in FIG. 1, the holder plate (11) may also be executed in a first part (11*a*) and a second part (11*b*). In this embodiment, the first part (11*a*) is attached slideably in relation to the frame (19) of the weaving machine in order to determine the position in the direction away from and towards the fabric (3), while the second part (11*b*) is positioned slideably in relation to the first part (11*a*) in order to determine the position in the direction of the weft.

The guiding yarns (7) can be fixed cords that are attached by one of their ends to the frame (19) of the weaving machine. Such a embodiment is not shown in the figures. However, the guiding yarns (7) can also be warp yarns running with the fabric (3), which extend in the shedding zone of the weaving machine through the eyes of heddles. In most cases, the heddles are suspended in a fixed weaving frame or to the frame (19) of the weaving machine. However, the heddles could also be controlled by, for instance, hooks of a jacquard machine.

The guiding yarns (7) are preferably spread over two reed dents positioned side by side. Per reed dent, more than one guiding thread (7) can be provided in order to push away the pile (4) rows that are positioned side by side more forcefully and to prevent them from being damaged by the cutting blade. This way, more free space is created to present the discarded pile loop weft yarns (2) to the cutting blade (5).

The device (1) is positioned in the weaving machine just before the zone where the discarded pile loop weft yarns (2) at both sides are pulled out of the fabric (3). If this is not done, the discarded pile loop weft yarns (2) are present in the fabric (3) in an uncontrolled manner. By placing the device (1) in this location in the weaving machine, the discarded pile loop weft yarns (2) remain tensioned for a longer period and they are quickly pulled out after cutting.

As shown in FIG. 7, the weaving machine is preferably provided with a guiding part (20) by which the fabric (3) is supported near the cutting blade (5) and the guiding needle (6).

The device (1) is ideally suitable for application in face-to-face weaving machines. In a face-to-face weaving machine, cutting of the discarded pile loop weft yarns (2) preferably takes place at a greater distance from the fabric edge of the sandwich fabric, i.e. in the direction of formation of the fabric in the zone where the upper and lower fabric are separate from each other. In this manner, the pile side face of the fabric can easily be observed by the weaver.

When fixed cords are used for the guiding yarns (7), they are attached by one of their ends to the frame (19) of the face-to-face weaving machine, and by their other end to the cutting device of the face-to-face weaving machine, provided for separation of the upper and lower fabric.

If the face-to-face weaving machine comprises three grippers to insert the weft yarn, i.e. an upper, middle and lower gripper, the warp yarns (7) that run with the fabric (3) are positioned for the upper fabric continuously between the weft drawn in by the upper gripper and the weft drawn in by the middle gripper and for the lower fabric continuously between the weft drawn in by the lower gripper and the weft drawn in by the middle gripper.

As shown in FIG. 1, the warp yarns (7) that run with the fabric can be led away through third guiding eyes (21) that are attached to the frame (19) of the face-to-face weaving machine.

By providing such device (1) according to the invention and a weaving machine, more precisely a face-to-face weaving machine, which is provided with such device (1), the weaver has, in case of a face-to-face weaving machine, a good view of the cutting of the discarded pile loop weft yarns (2). In addition, the cutting device needs no longer to be incorporated within the compact space between the upper fabric and the lower fabric, but there is space available to incorporate a more stable cutting device (1).

Inspection and replacement of a cutting blade (5) is simplified both by better accessibility and by the possibility to design the cutting blade (5) or the cutting blade (5) with the guiding needle (6) in an easily removable manner. The cutting blade (5) can be encased or masked in a simple manner by a masking plate (18) so that the weaver is protected against cutting injuries in case of accidental snagging.

In the case of face-to-face weaving of fabrics with pile loops, the discarded pile loop weft yarns (2) in both fabrics (3) are cut at a certain distance from each other, so that it is no longer possible that discarded pile loop weft yarns (2) would be cut simultaneously in both fabrics (3), or that parts of discarded pile loop weft yarn (2) would remain behind in the middle part of the fabric (3).

The invention claimed is:

1. Device for cutting discarded pile loop weft yarns in a fabric, that is composed of a backing fabric consisting of weft yarns and warp yarns, and that comprises pile warp yarns by which, in one or several zones, pile loops are formed over discarded pile loop weft yarns, said device being provided with a cutting blade to cut the discarded pile loop weft yarns, wherein the device comprises a guiding needle that extends between two rows of pile positioned side by side in the direction of the warp, and said device being provided with two or several guiding yarns in the direction of the warp that push this side by side positioned pile away from the guiding needle and the cutting blade in the direction of the weft and that, at the same time, pull the discarded pile loop weft yarns away from the backing fabric in order to present them over the guiding needle to the cutting blade so that they can be cut.

2. Device according to claim 1, wherein the guiding needle is provided with a first guiding eye through which the guiding yarns can be threaded.

3. Device according to claim 2, wherein the guiding yarns cross in relation to the guiding needle when they extend through the first guiding eye of the guiding needle.

4. Device according to the claim 1, wherein the device is provided with a holder plate that, in the direction of the warp, is provided at both sides of the cutting blade with second guiding eyes, guiding sleeves or guiding tubes that guide the guiding yarns.

5. Device according to the claim 1, wherein the device is provided with a floating part to which the guiding needle and the cutting blade are attached.

6. Device according to claim 5, wherein the floating part consists of a rod device, i.e. two sideways rods, an upper rod and a lower rod, in the shape of a parallelogram, in which, upon rotation of the sideways rods, the lower rod performs a virtually horizontal movement.

7. Device according to claim 5, wherein the floating part is executed as a holder in which the cutting blade and the guiding needle are integrated and that, in relation to the holder plate, is provided in a floating and slideable way in the direction of the weft via a linear guide.

8. Device according to claim 1, wherein the device is provided with a yarn breakage detection device to detect any breakage of the guiding yarns.

9. Device according to claim 1, wherein the cutting blade or the cutting blade with the guiding needle is provided detachably in a blade holder.

10. Device according to claim 1, wherein on the blade holder devices are provided to adjust the distance between the guiding needle/cutting blade and the backing fabric.

11. Device according to claim 1, wherein the device is provided with a masking plate to mask the cutting blade.

12. Weaving machine for weaving a fabric that is composed of a backing fabric consisting of weft yarns and warp yarns, and that comprises pile warp yarns by which pile loops are formed over discarded pile loop weft yarns in one or several zones, wherein the weaving machine is provided with a device being provided with a cutting blade to cut the discarded pile loop weft yarns wherein the device comprises a guiding needle that extends between two rows of pile positioned side by side in the direction of the warp, and said device being provided with two or several guiding yarns in the direction of the warp that push this side by side positioned pile away from the guiding needle and the cutting blade in the direction of the weft and that, at the same time, pull the discarded pile loop weft yarns away from the backing fabric in order to present them over the guiding needle to the cutting blade so that they can be cut.

13. Weaving machine according to claim 12, wherein the guiding yarns are spread over two reed dents positioned side by side.

14. Weaving machine according to claim 13, wherein per reed dent, more than one guiding thread is provided.

15. Weaving machine according to claim 12, wherein the device via said holder plate is attached to the frame of the weaving machine.

16. Weaving machine according to claim 15, wherein the holder plate is attached slideably to the frame of the weaving machine in the direction of the weft and away from and towards the fabric.

17. Weaving machine according to claim 15, wherein the holder plate is executed as a first part and a second part, in which the first part is attached slideably in relation to the frame of the weaving machine in order to determine the position in the direction away from and towards the fabric, and the second part is positioned slideably in relation to the first part in order to determine the position in the direction of the weft.

18. Weaving machine according to claim 12, wherein the guiding yarns are fixed cords that are attached by one of their ends to the frame of the weaving machine.

19. Weaving machine according to claim 12, wherein the guiding yarns are warp yarns running with the fabric that extend into the shedding zone of the weaving machine through the eyes of heddles.

20. Weaving machine according to claim 19, wherein the heddles are suspended in a fixed weaving frame or to the frame of the weaving machine.

21. Weaving machine according to claim 19, wherein said heddles are controlled by hooks of a jacquard machine.

22. Weaving machine according to claim 12, wherein, in relation to the weaving direction, the device is positioned in the weaving machine just before the zone in which the discarded pile loop weft yarns at both sides are pulled out of the fabric.

23. Weaving machine according to claim 12, wherein the weaving machine is provided with a guiding part by which, at the location of the cutting blade and the guiding needle, the fabric is supported at its backside.

24. Weaving machine according to claim 12, wherein the weaving machine is a face-to-face weaving machine.

25. Weaving machine according to claim 24, wherein the device in the face-to-face weaving machine is positioned in the zone where the upper and lower fabric are separate from each other.

26. Weaving machine according to claim 24, wherein the fixed cords are attached by one of their ends to the frame of the face-to-face weaving machine, and by their other end to the cutting device of the face-to-face weaving machine, which is provided to separate the upper and lower fabric.

27. Weaving machine according to claim 24, wherein the face-to-face weaving machine comprises three grippers to insert the weft yarn, i.e. an upper, middle and lower gripper, whereby the warp yarns that run with the fabric are, for the upper fabric, continuously positioned between the weft brought in by the upper gripper and the weft brought in by the middle gripper, and for the lower fabric, are continuously positioned between the weft brought in by the lower gripper and the weft brought in by the middle gripper.

* * * * *